US008468834B2

(12) United States Patent
Khosla et al.

(10) Patent No.: US 8,468,834 B2
(45) Date of Patent: Jun. 25, 2013

(54) FUEL INJECTOR NOZZLE

(75) Inventors: Sachin Khosla, Greenville, SC (US); Mihir Lal, Greer, SC (US); Daniel Scott Zehentbauer, Hanoverton, OH (US)

(73) Assignee: General Electric Company, Schenectady, NY (US)

( * ) Notice: Subject to any disclaimer, the term of this patent is extended or adjusted under 35 U.S.C. 154(b) by 777 days.

(21) Appl. No.: 12/705,150

(22) Filed: Feb. 12, 2010

(65) Prior Publication Data

US 2011/0197588 A1 Aug. 18, 2011

(51) Int. Cl.
*F02C 1/00* (2006.01)

(52) U.S. Cl.
USPC ..... 60/742

(58) Field of Classification Search
USPC ..... 60/740, 742, 746, 748, 775; 239/290, 239/294–301, 399, 407, 408, 416.5, 418, 239/423, 433
See application file for complete search history.

(56) References Cited

U.S. PATENT DOCUMENTS

| | | | | |
|---|---|---|---|---|
| 1,921,059 | A | 7/1931 | Weil et al. | |
| 2,323,464 | A | 5/1942 | Glessner | |
| 3,076,642 | A | 10/1960 | Dhenein | |
| 3,908,903 | A * | 9/1975 | Burns, Jr. | 239/2.2 |
| 4,110,973 | A | 9/1978 | Haeflich et al. | |
| 4,510,874 | A | 4/1985 | Hasenack | |
| 4,546,923 | A | 10/1985 | Ii | |
| 5,090,619 | A * | 2/1992 | Barthold et al. | 239/14.2 |
| 5,127,346 | A * | 7/1992 | Kepplinger et al. | 110/264 |
| 5,302,112 | A | 4/1994 | Nabors, Jr. et al. | |
| 5,344,306 | A | 9/1994 | Brown et al. | |
| 5,628,184 | A | 5/1997 | Santos | |
| 5,836,164 | A | 11/1998 | Tsukahara et al. | |
| 5,988,531 | A | 11/1999 | Maden et al. | |
| 6,021,635 | A | 2/2000 | Gaag et al. | |
| 6,126,438 | A | 10/2000 | Joshi et al. | |
| 6,152,052 | A * | 11/2000 | Saxon et al. | 110/262 |
| 6,598,383 | B1 | 7/2003 | Vandervort et al. | |
| 6,598,801 | B1 | 7/2003 | Fortuna et al. | |
| 6,715,295 | B2 | 4/2004 | Gadde et al. | |
| 6,758,407 | B1 | 7/2004 | Lambert et al. | |
| 6,802,178 | B2 | 10/2004 | Sprouse et al. | |
| 7,104,070 | B2 | 9/2006 | Iasillo et al. | |
| 7,143,583 | B2 * | 12/2006 | Hayashi et al. | 60/776 |
| 2003/0015604 | A1 * | 1/2003 | Kobayashi et al. | 239/299 |
| 2006/0080966 | A1 | 4/2006 | Widener | |
| 2010/0101204 | A1 * | 4/2010 | Berry et al. | 60/39.53 |

* cited by examiner

*Primary Examiner* — Phutthiwat Wongwian
(74) *Attorney, Agent, or Firm* — Cantor Colburn LLP

(57) ABSTRACT

A fuel injector nozzle is disclosed. The nozzle includes a nozzle body for fluid communication of a liquid fuel to produce a liquid fuel jet and a fluid to produce a fluid jet. The nozzle body includes an adapter comprising a fuel conduit and a fluid conduit. The nozzle body also includes a nozzle tip disposed on the adapter comprising a plurality of fuel outlet conduits that are in fluid communication with the fuel conduits and a plurality of fluid outlet conduits that are in fluid communication with the fluid conduits.

20 Claims, 10 Drawing Sheets

FUEL INJECTOR NOZZLE

BACKGROUND OF THE INVENTION

Natural gas is, in many cases, the fuel of choice for firing gas turbines because of its lower cost and desirable combustion characteristics as compared with alternative fuels. Many combustion turbines, though, have the capability to fire either natural gas or a liquid fuel, including various grades of diesel fuel, such as No. 2 diesel fuel, depending on cost, availability and desired combustion characteristics. In many cases the liquid fuel system is used primarily as a backup system. As an example, current Dry Low $NO_X$ (DLN) combustors generally utilize a backup liquid fuel system. In other cases, gas turbine sites seasonally operate on liquid fuel due to the lower cost or enhanced availability of the liquid fuel.

While liquid fuel systems are desirable, either as a backup or alternate fueling system, their operating and maintenance costs are currently prohibitive. Atomizing air is frequently used to provide atomization of the liquid fuel to obtain desirable combustion characteristics, including improved emissions and turbine performance. Atomizing air systems require bleeding compressor air and using pumps to raise the air pressure to a level sufficient for liquid fuel atomization. They impose additional capital equipment and maintenance costs and reduce turbine and power plant efficiency. Thus, elimination of atomizing air systems is desirable to reduce capital equipment and maintenance costs, reduce system complexity and improve the power plant reliability and heat rate.

Therefore, improved liquid fueling systems and fueling methods that avoid the disadvantages described above are desirable.

BRIEF DESCRIPTION OF THE INVENTION

According to one aspect of the invention, a fuel injector nozzle is disclosed. The nozzle includes a nozzle body for fluid communication of a liquid fuel to produce a liquid fuel jet and a fluid to produce a fluid jet. The nozzle body includes an adapter comprising a fuel conduit and a fluid conduit. The nozzle body also includes a nozzle tip disposed on the adapter comprising a plurality of fuel outlet conduits that are in fluid communication with the fuel conduits and a plurality of fluid outlet conduits that are in fluid communication with the fluid conduits.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 2:
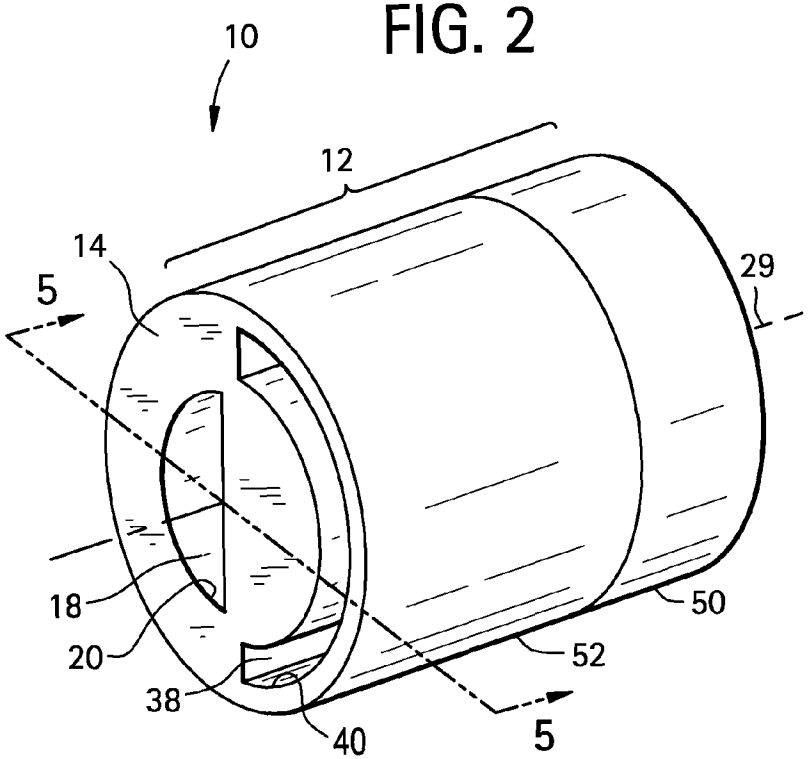
FIG. 2 is a rear perspective view of the fuel injector nozzle of FIG. 1.
Figure 1:
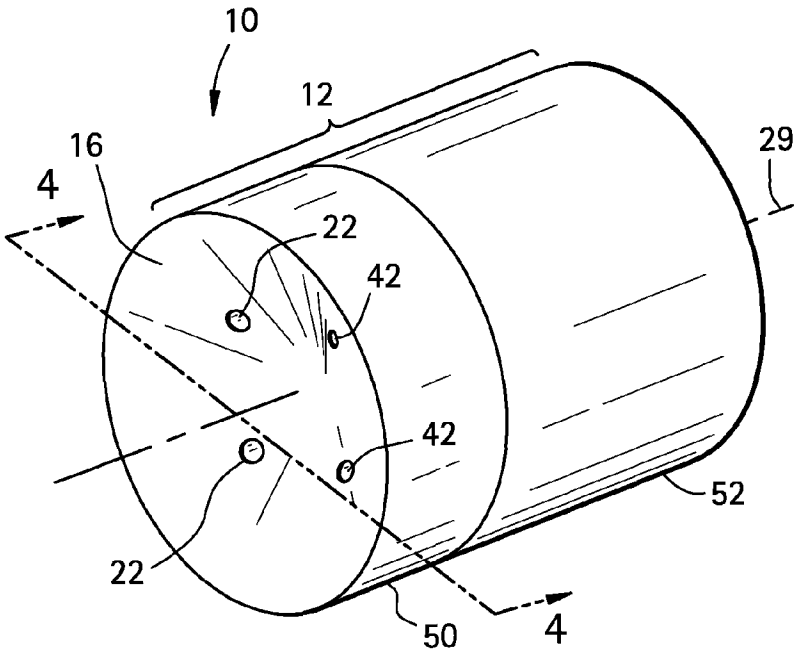
FIG. 1 is a front perspective view of an exemplary embodiment of a fuel injector nozzle as disclosed herein.
Figure 3:
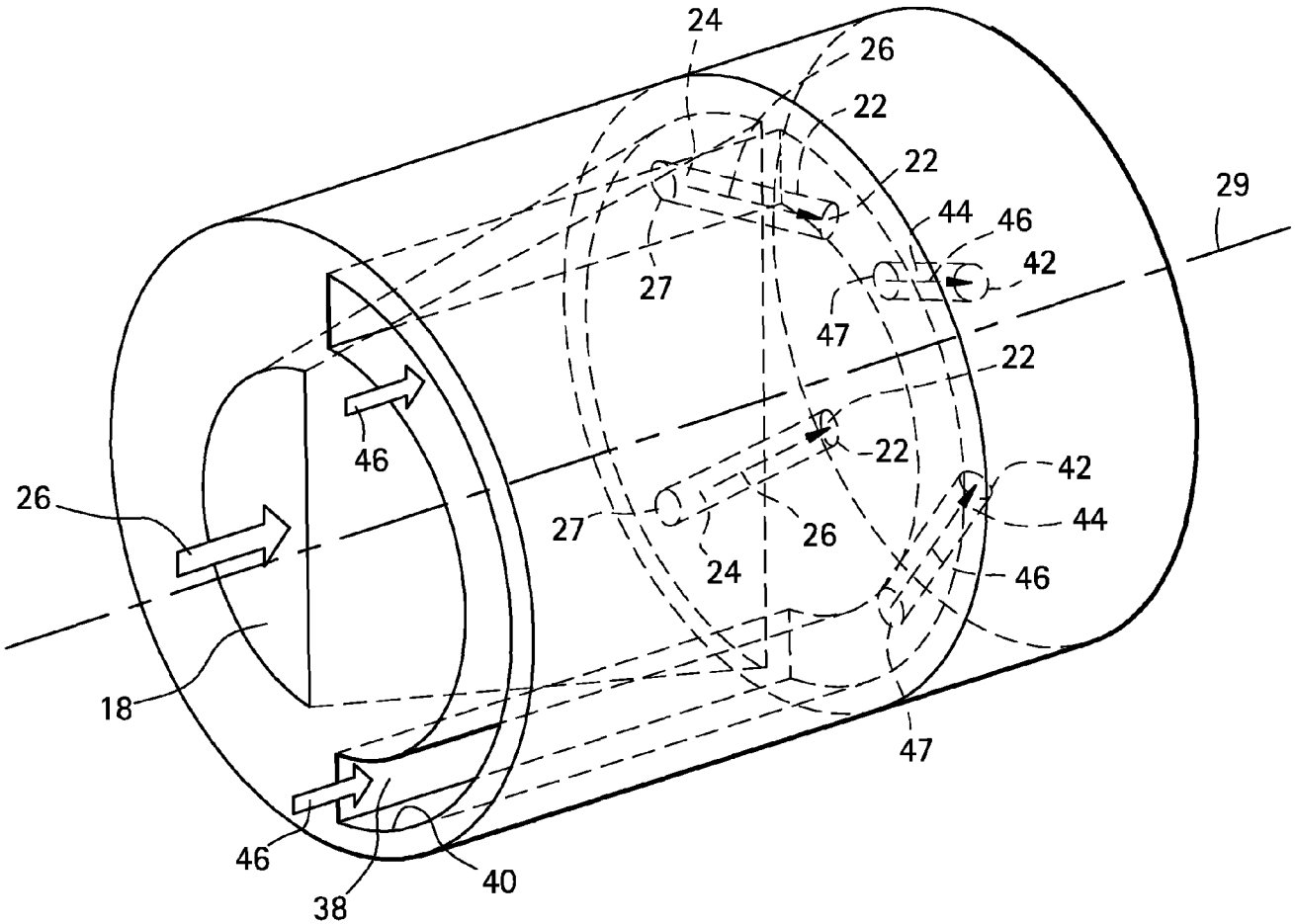
FIG. 3 is an enlarged view of FIG. 2 that also includes phantom lines to illustrate interior features of the fuel injector nozzle.
Figure 4:
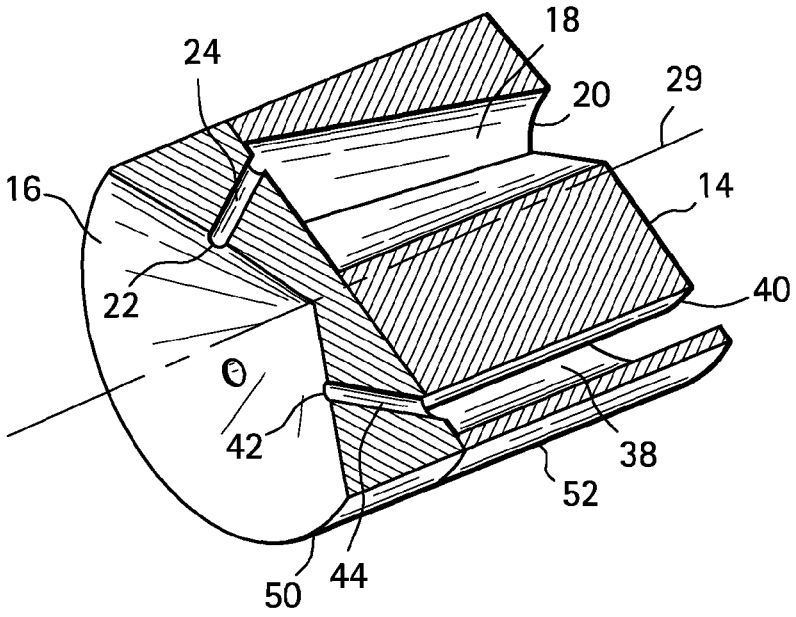
FIG. 4 is a cross-sectional view of the fuel injector nozzle of FIG. 1 taken along section 4-4.
Figure 5:
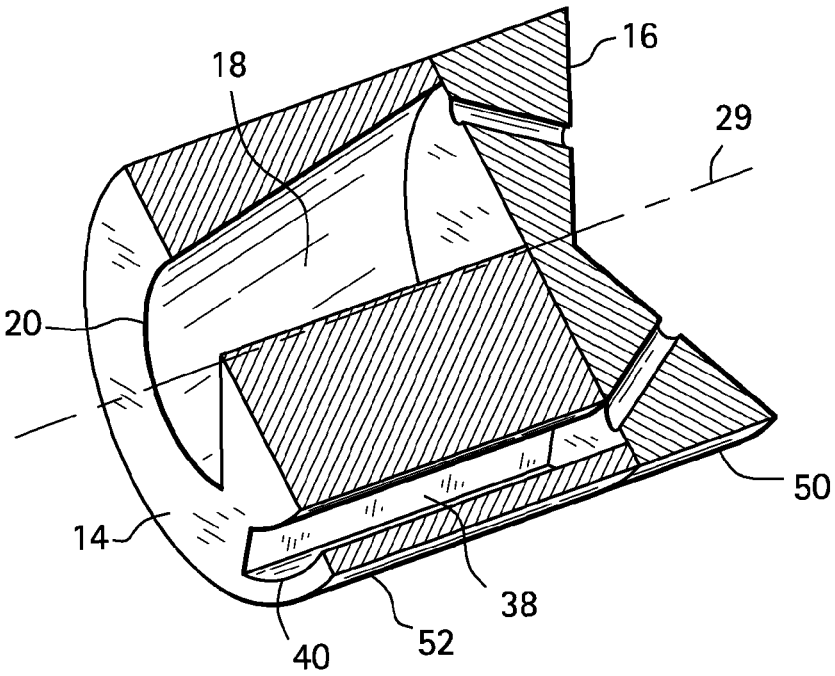
FIG. 5 is a cross-sectional view of the fuel injector nozzle of FIG. 2 taken along section 5-5.
Figure 6:
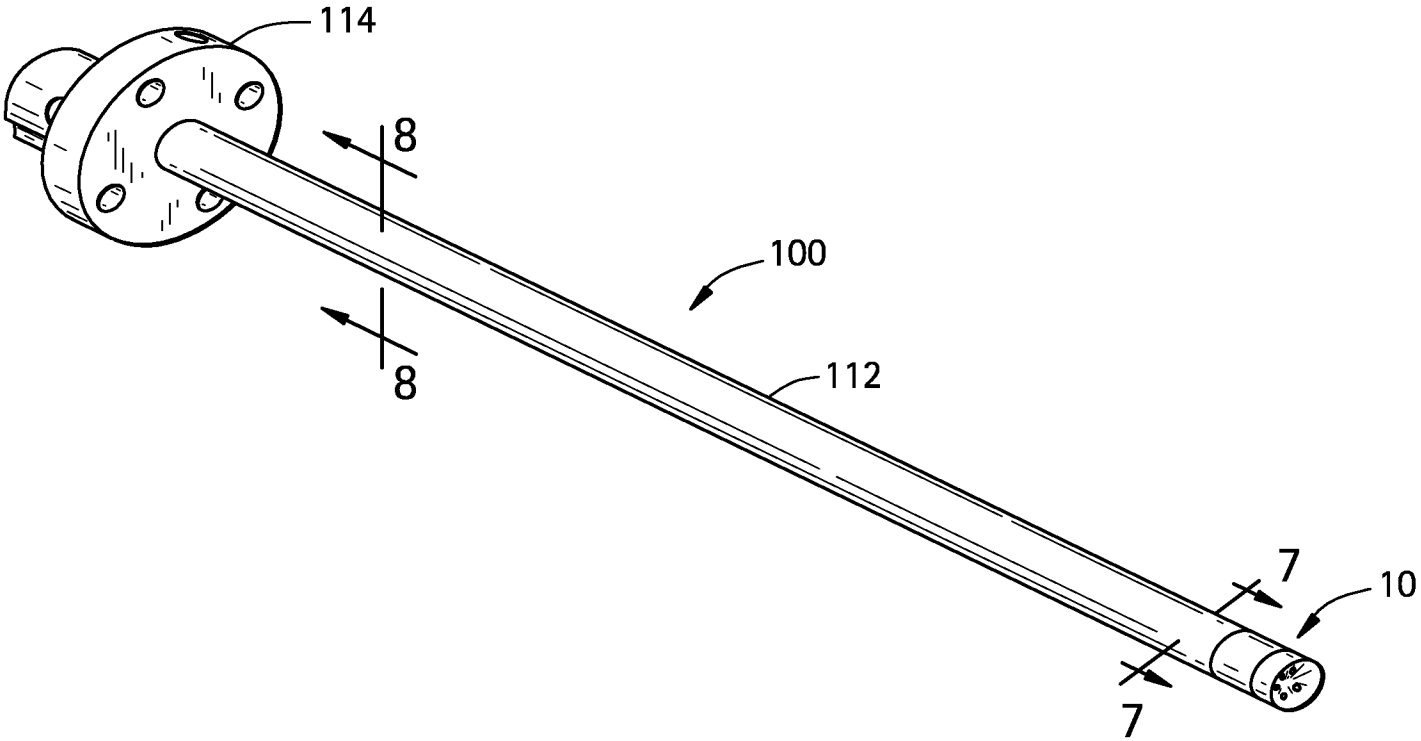
FIG. 6 is a perspective view of an exemplary embodiment of a fuel injector nozzle and fuel injector incorporating the same.

Referring to FIGS. 1-10, an exemplary embodiment of a fuel injector nozzle 10 is illustrated. Fuel injector nozzle 10 includes a nozzle body 12 that is configured for attachment to and fluid communication with a fuel cartridge or fuel injector 100 used in the combustor (not shown) of a gas turbine (not shown) to provide jets of liquid fuel, or jets of liquid fuel and another fluid, such as water, to atomize the fuel for combustion in the combustion chamber (not shown) of the combustor. Nozzle body 12 may have any suitable shape, including a right cylindrical shape as shown, and will generally have a shape that is configured for attachment to the fuel injector 100 to which it is joined (FIG. 6). Nozzle body 12 has an inlet end 14 and an opposed discharge or outlet end 16.

Nozzle body 12 also includes a fuel conduit 18 that extends from a fuel inlet 20 on inlet end 14 to a fuel outlet 22, or a plurality of fuel outlets 22, located on outlet end 16. Fuel outlet or outlets 22 are in fluid communication with fuel outlet conduit 24, or plurality of fuel outlet conduits 24, located proximate to outlet end 16. Fuel outlets 22 are in fluid communication with and serve as the terminus of fuel conduit 18 and respective fuel outlet conduits 24. As illustrated, for example, in FIGS. 1-7, a plurality of fuel outlet conduits 24 may extend from a single fuel conduit 18 that serves as a plenum to distribute a pressurized liquid fuel, illustrated by arrow 26, which flows into fuel inlet 20 through fuel conduit 18 and into fuel outlet conduits 24, where it is discharged as pressurized flow streams or jets 23 of liquid fuel 26 through fuel outlets 22 on outlet end 16. Liquid fuel 26 may include any liquid hydrocarbon suitable for combustion in the combustion chamber of a gas turbine, including various grades of diesel fuel (e.g., No. 2 diesel fuel). Fuel conduit 18 may have any suitable size and shape. In the exemplary embodiment of FIGS. 1-7, fuel conduit 18 has a semi-circular cross-sectional shape with area that increases in size away from fuel inlet 20.

Fuel outlet conduits 24 have inlets 27 located within the semi-circular cross-section of fuel conduit 18. Fuel outlet conduits 24 may have a smaller cross-sectional area and a different cross-sectional shape than fuel conduit 18 in order to increase the pressure of the pressurized liquid fuel 26 and provide jets 23 of liquid fuel 26 having predetermined jet characteristics, such as pressure, flow rate, jet shape and the like. Fuel outlet conduits 24 and fuel outlets 22 may have any suitable cross-sectional shape, cross-sectional size, length, spatial location and orientation in order to provide jets 23 having predetermined jet characteristics using the portion of pressurized liquid fuel 26 that flows therein. The predetermined jet characteristics may be selected to provide atomization of the liquid fuel as described herein. In the exemplary embodiment of FIGS. 1-7, fuel outlet conduits 24 have respective inwardly converging fuel outlet conduit axes 28 and fuel outlets 22 and fuel outlet conduits 24 are spaced to provide jets 23 of liquid fuel 26 that converge inwardly away from outlet end 16. In the exemplary embodiment of FIGS. 1-7, fuel outlets 22 are radially and circumferentially spaced about a longitudinal axis 29 so that respective jets of liquid fuel 23 are focused along longitudinal axis 29 at a focal point that is determined by the fuel jet angle ($\alpha$) (FIG. 7) that is defined by the angle of the fuel outlet conduit axes 28 with longitudinal axis 29. The fuel jet angle ($\alpha$) may be selected to provide predetermined impact characteristics of the jet or jets 23 with a jet or jets of a liquid fluid, as described herein, to provide a resultant flow stream 25 of atomized liquid fuel 26 having predetermined stream characteristics, including the stream shape, size, atomized particle size (e.g., average size) and size distribution, liquid fuel mass flow rate and the like.

Nozzle body 12 also includes a fluid conduit 38 that extends from a fluid inlet 40 on inlet end 14 to a fluid outlet 42, or plurality of fluid outlets 42, located on outlet end 16. Fluid outlet or outlets 42 are in fluid communication with fluid outlet conduit 42, or a plurality of conduits 44, located proximate to outlet end 16. Fluid outlets 44 are in fluid communication with and serve as the terminus of fluid conduit 38 and respective fluid outlet conduits 44. As illustrated, for example, in FIGS. 1-7, a plurality of fluid outlet conduits 44 may extend from a single fluid conduit 38 that serves as a plenum to distribute a pressurized liquid fluid, illustrated by arrow 46, which flows into fluid inlet 40 through fluid conduit 38 and into fluid outlet conduits 44, where it is discharged as pressurized flow streams or jets 43 of liquid fuel 46 through fluid outlets 42 on outlet end 16. Fluid conduit 38 may have any suitable size and shape. In the exemplary embodiment of FIGS. 1-7, fluid conduit 38 has a semi-annular or ring-like cross-sectional shape that is the same along its length within nozzle body 12.

Fluid outlet conduits 44 have inlets 47 located within this semi-annular cross-section of fluid conduit 38. Fluid outlet conduits 44 may have a smaller cross-sectional area and a different cross-sectional shape than fluid conduit 38 in order to increase the pressure of the pressurized liquid fluid 46 and provide jets 43 of liquid fluid 46 having predetermined jet characteristics, such as pressure, flow rate, jet shape and the like. Fluid outlet conduits 44 and fluid outlets 42 may have any suitable cross-sectional shape, cross-sectional size, length, spatial location and orientation in order to provide jets 43 having predetermined jet characteristics from the portion of pressurized liquid fluid 46 that flows therein. The predetermined jet characteristics may be selected to provide atomization of the liquid fuel 26, as described herein. In the exemplary embodiment of FIGS. 1-7, fluid outlet conduits 44 have respective inwardly converging fluid outlet conduit axes 48 and fluid outlets 42 and conduits 44 are spaced to provide jets 43 of liquid fluid 46 that converge inwardly away from outlet end 16. In the exemplary embodiment of FIGS. 1-7, fluid outlets 42 are radially and circumferentially spaced about longitudinal axis 29 of nozzle body 12 so that a jet 43, or plurality of jets 43, of liquid fluid 46 is focused to impact a jet 23, or a plurality of jets, of liquid fuel 26 along longitudinal axis 29 at a focal point that is determined by the fuel jet angle ($\alpha$) and fluid jet angle ($\beta$), where angle $\beta$ is defined by the angle of the fluid outlet conduit axes 48 with longitudinal axis 29. This angle ($\beta$) may be selected to provide predetermined impingement and impact characteristics of jet or jets 23 and jet or jets 43, including a resultant flow stream 25 of atomized liquid fuel 26 having predetermined stream characteristics, including the stream shape, size, atomized particle size (e.g., average size) and size distribution, liquid fuel mass flow rate and the like.

Figure 7:
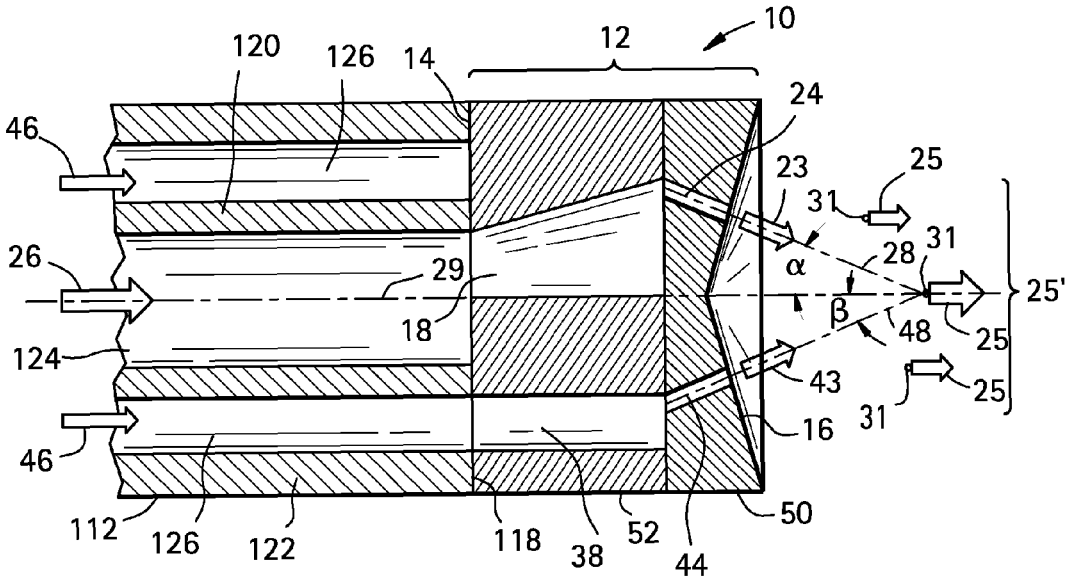
FIG. 7 is a cross-sectional view of the exemplary embodiments of FIG. 6 taken along section 7-7.

Jets 43 of liquid fluid 46 are used for impacting the jets 23 of liquid fuel 26 and forming the flow stream 25 of atomized liquid fuel 26. In one exemplary embodiment, liquid fluid 46 may include liquid fuel 26, such that jets 43 are effectively jets 23. In this embodiment, at least two jets 23 of liquid fuel 26 are impacted with one another to atomize liquid fuel 26 and form flow stream 25 that includes atomized liquid fuel 26. Any number of jets 23 may be impacted with one another to provide flow stream 25 that includes atomized liquid fuel 26 having the predetermined stream characteristics described herein, including a predetermined mass flow rate of liquid fuel. In this embodiment, each jet 23 will be oriented and directed as described herein to be impacted by at least one other jet 23 that has also been oriented and directed to provide the desired impact. The focal point 31 or impact point may be selected to fall on longitudinal axis 29, or may be selected by appropriate orientation and location of fuel outlets 22 and fuel outlet conduits 24 to position focal point 31 at a location in front of outlet end 16 that is not on longitudinal axis 29, as illustrated in FIG. 7. It will be appreciated that by defining a plurality of jet 23 pairs that are oriented for impact as described herein, a corresponding plurality of focal points 31 may be defined at a corresponding plurality of locations in front of outlet end 16, and that the corresponding plurality of flow streams 25 that include atomized liquid fuel 26 may form a composite flow stream 25' having predetermined composite stream characteristics. In this embodiment, liquid fuel 26 may be supplied through both fuel conduit 18 and fluid conduit 38 as in the configuration illustrated in FIG. 7 where the liquid fluid 46 is fuel, such that both conduits are effectively fuel conduits, or that nozzle body simply have a single fuel conduit 18 that is configured to supply fuel outlet conduits 24 and fluid outlet conduits 44, such that they are both effectively fuel outlet conduits 24.

In another exemplary embodiment, liquid fluid 46 may include water to provide a predetermined combustion characteristic, such as a reduction of the temperature within the combustor, the turbine inlet temperature, or the firing temperature. In this embodiment, at least one jet 23 of liquid fuel 26 and at least one jet 43 of liquid fluid 46 are impacted with one another to atomize and emulsify liquid fuel 26 and liquid fluid 46 (e.g., water) and form flow stream 25 that includes atomized and emulsified liquid fuel 26-liquid fluid 46. Without being intending to be bound by theory, the impact of the jet 23 of liquid fuel and jet 43 of liquid fluid 46 both atomizes and intermixes the liquid fuel 26 and the liquid fluid 46 producing an atomized emulsion of liquid fuel 26-liquid fluid 46. The atomized emulsion may include atomized droplets of water that are covered or coated with fuel. The heat provided by the combustor causes the water droplets to rapidly vaporize. The heat of vaporization associated with vaporization of the water lowers the temperature within the combustor to be lowered and the rapid vaporization causes the droplets to explode, thereby providing even smaller droplets of fuel and further enhancing its atomization and combustion characteristics. Any number of jets 23 may be impacted with any number of jets 43 to provide flow stream 25 that includes atomized and emulsified liquid fuel 26-liquid fluid 46 having the predetermined stream characteristics described herein. In this embodiment, each jet 23 of liquid fuel 26 will be oriented and directed as described herein to be impacted by at least one jet 43 of liquid fluid 46 that has also been oriented and directed to provide the desired impact. The focal point 31 or impact point may be selected to fall on longitudinal axis 29, or may be selected by appropriate orientation and location of fuel outlets 22 and fuel outlet conduits 24 as well as fluid outlets 42 and fluid outlet conduits 44 to position focal point 31 at a location in front of outlet end 16 that is not on longitudinal axis 29, as illustrated in FIG. 7. It will be appreciated that by defining a plurality of jet 23 and jet 43 pairs that are oriented for impact as described herein, a corresponding plurality of focal points 31 may be defined at a corresponding plurality of locations in front of outlet end 16, and that the corresponding plurality of flow streams 25 of atomized liquid fuel 26 may form a composite flow stream 25' having predetermined composite stream characteristics.

Nozzle body 12, including nozzle tip 50 and adapter 52, may be formed by any suitable forming method, including forming the nozzle body 12 as an integral, one-piece component and may alternately be represented by a single type of sectioning or hatching. Nozzle body 12 may be formed as an integral component utilizing investment casting methods to create fuel conduit 18 of adapter 52, then using conventional machining techniques to create fluid conduit 38 of adapter 52 and fuel outlet conduits 24 and fluid outlet conduits 44 of nozzle tip 50. Alternately, nozzle body 12 may be formed by joining a separately formed nozzle tip 50 having fuel outlet conduits 24 and fluid outlet conduits 44 formed therein, to a separately formed adaptor 52 having fuel conduit 18 and fluid conduit 38 formed therein. Nozzle tip 50 and adapter 52 may be joined by any joining method suitable for forming a metallurgical bond 51 between them, including various forms of welding, so that metallurgical bond 51 may include a weld. Nozzle tip 50 and adapter 52 may also be joined by brazing to form metallurgical bond 51, which is a metal joining process where a filler metal is distributed between two or more close-fitting parts using capillary action to draw the braze material into the space between the parts and form a metallurgical bond between them, so that metallurgical bond 51 may include a braze joint. Adapter 52 may be formed, for example, by investment casting to create the cylindrical outer shape and fuel conduit 18, and then using conventional machining techniques to create fluid conduit 38.

Nozzle body 12 may be formed from any suitable high temperature material that is adapted to withstand the firing temperature of a gas turbine combustor, about 2900° F. In an exemplary embodiment, nozzle body 12 may be formed from a superalloy, such as an Ni-based superalloy, including, as an example, Hastalloy X (UNS N06002). The outlet end 16 of nozzle body 12 may have any suitable shape profile, including the inwardly concave or conical shape shown in FIG. 7.

Figure 8:
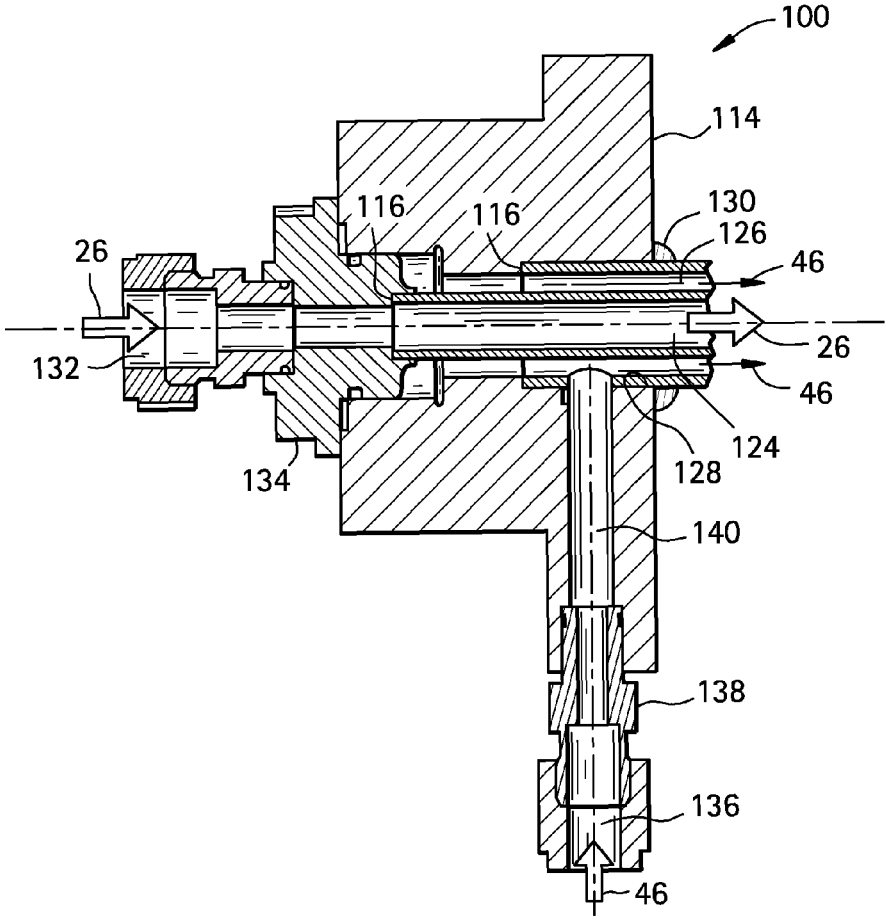
FIG. 8 is a cross-sectional view of the exemplary embodiments of FIG. 6 taken along section 8-8.

Referring to FIGS. 6-8, fuel injector nozzle 10 is configured for use with and disposition in fuel injector 100. Fuel injector 100 may have any suitable cross-sectional shape and length, including the substantially cylindrical shape illustrated in FIGS. 6-8. Fuel injector 100 includes a partitioned fluid tube 112 that is disposed within a mounting flange 114. Partitioned tube 112 extends from an inlet end 116 to an outlet end 118 that is joined to inlet end 14 of nozzle body 12. Partitioned tube 112 may be partitioned using any suitable partition arrangement to enable passage of at least two fluids along the length of the tube from the inlet end 116 to the outlet end 118, as illustrated in FIGS. 7 and 8, in an exemplary embodiment partition tube 112 is partitioned using a concentric tube arrangement wherein inner tube 120 is concentrically disposed within outer tube 122. Inner tube 120 and outer tube 122 are sized on their respective inner and outer diameters, to define a fuel circuit 124 within inner tube 120 and a fluid circuit 126 between inner tube 120 and outer tube 122. In an exemplary embodiment, fluid circuit 126 may be a fuel circuit for providing pressurized liquid fuel as described herein. In another exemplary embodiment, fluid circuit 126 may provide a pressurized liquid fluid 46, including water, as described herein. The nozzle body 12 may be joined to partitioned tube 112 using any suitable joining method, including various forms of welding. The inlet end or ends 116 of partition tube 112 will be disposed within a mating recess or recesses 128 formed within mounting flange 114 and may be joined to mounting flange 114 by a weld or welds 130. Fuel circuit 124 is in fluid communication with a source of pressurized liquid fuel 26 through external fuel circuit 132 comprising various pipes or conduits (not shown), which may be fluidly coupled to fuel injector 100 using a suitable detachably attachable connector 134. Similarly, fluid circuit 126 is in fluid communication with a source of pressurized liquid fluid 46 through an external fluid circuit 136 comprising various pipes or conduits (not shown) for communicating liquid fluid 46 that may be detachably detached to fuel injector 100 and mounting flange 114 through a detachably attachable connector 138. Fluid circuit 126 may also include a mounting flange conduit 140 formed within and in fluid communication with fluid circuit 126.

Figure 9:
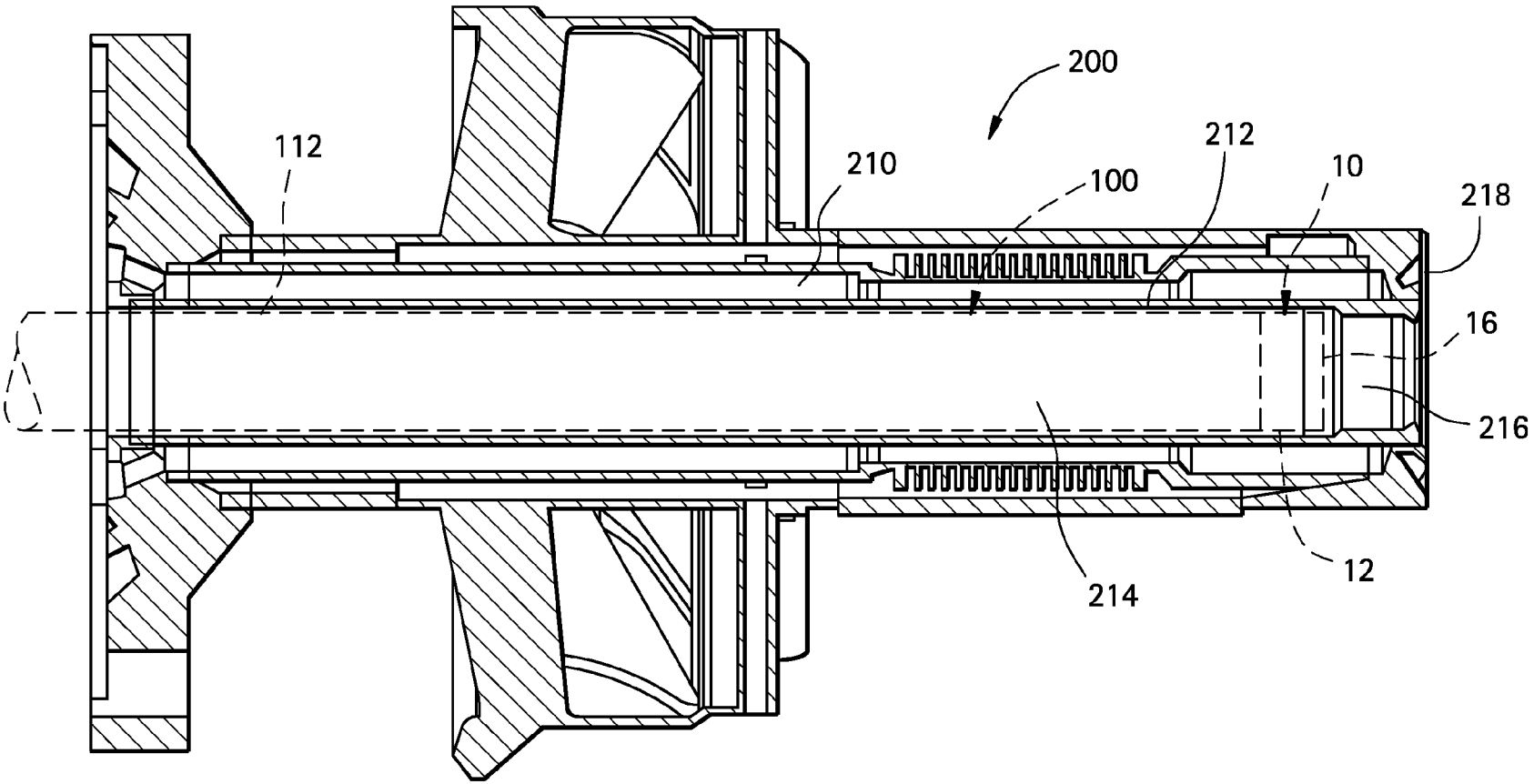
FIG. 9 is a cross-sectional view of an exemplary embodiment of a combustor fuel nozzle as disclosed herein.
Figure 10:
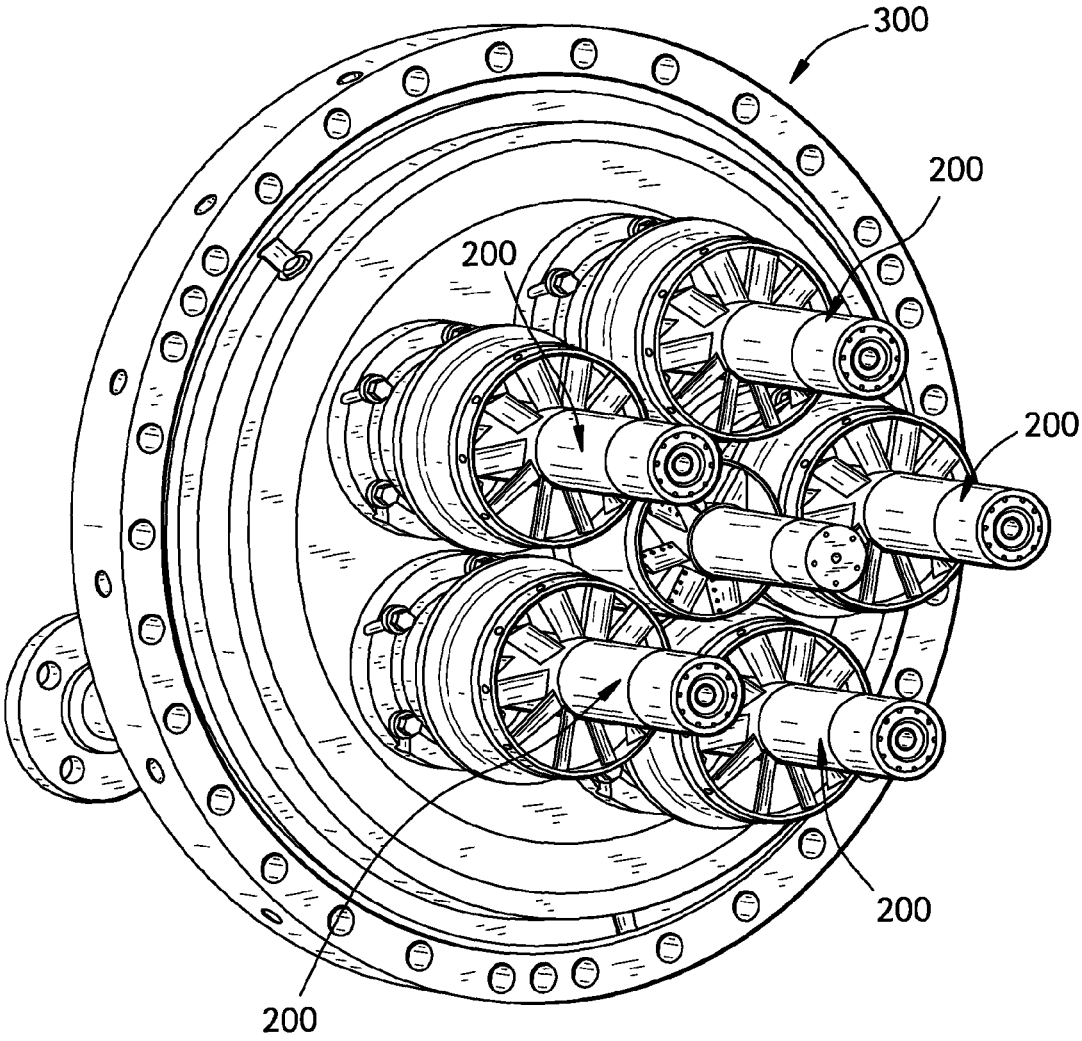
FIG. 10 is a front perspective view of an exemplary embodiment of a plurality of combustor fuel nozzles and a combustor can incorporating the same as disclosed herein.

Referring to FIGS. 9 and 10, fuel injector 100 may be disposed in a combustor fuel nozzle 200 that is used to provide natural gas as a primary fuel for the combustor of a gas turbine. Combustor fuel nozzle 200 includes a natural gas circuit 210 that is bounded on one side by inner tube 212 that defines a fuel injector cavity 214 that is configured to receive fuel injector 100, including partitioned tube 112 and nozzle 10, with outlet end 16 of nozzle body 12 disposed in an opening 216 at a distal end 218 of the combustor nozzle. Nozzle body 12 is configured to inject a secondary or back-up fuel into the combustor as an atomized liquid fuel-liquid fluid emulsion through opening 216. As shown in FIG. 10, a plurality of combustor fuel nozzles 200 that include fuel injectors 100 may be combined to form a combustor can 300. A plurality of combustor cans 300 (not shown), each combustor can comprising a plurality of combustor fuel nozzles 200 and fuel injectors 100, may be circumferentially positioned in a conventional manner around a combustor section (not shown) of a gas turbine to provide a gas turbine that has dual fuel capability, or that provides a gas turbine having a primary (natural gas) and secondary or back-up (liquid fuel) fueling capability.

Figure 11:
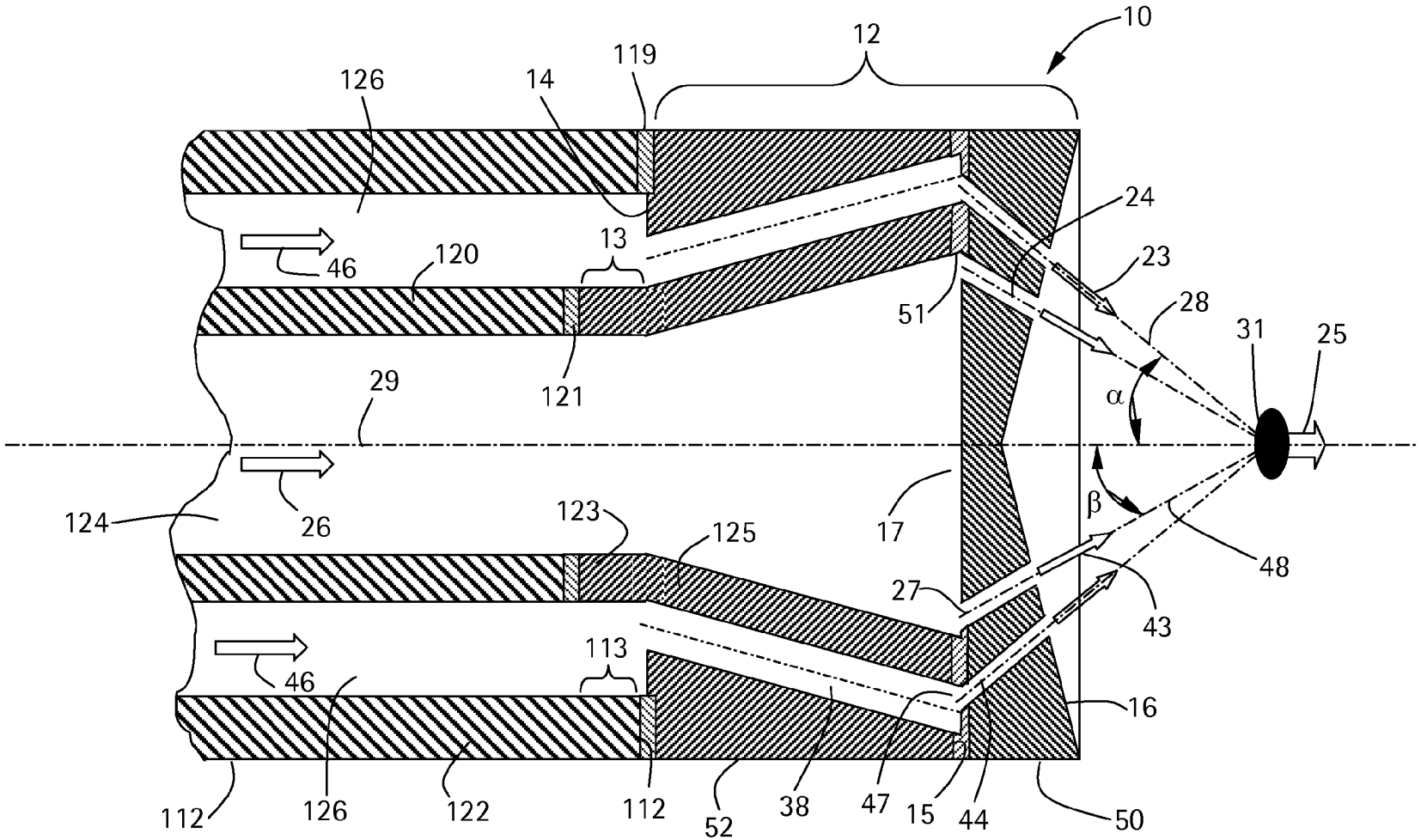
FIG. 11 is a cross-sectional view of a second exemplary embodiment of a fuel injector nozzle as disclosed herein.

FIG. 11 illustrates a second exemplary embodiment of a fuel injector nozzle 10. Fuel injector nozzle 10 includes nozzle body 12 and the other elements of the nozzle as disclosed herein. In this embodiment, the fuel conduit 18 and fluid conduit 38 of adapter 52 may be disposed such that one conduit is disposed within the other conduit, including a configuration where one conduit is concentrically disposed with respect to the other conduit. In the exemplary embodiment of FIG. 11, fuel conduit 18 is disposed within fluid conduit 38, and more particularly fuel conduit 18 is concentrically disposed within fluid conduit 38. However, this configuration may be reversed so that fluid conduit 38 is disposed within fuel conduit 18, and more particularly fluid conduit 38 is concentrically disposed within fuel conduit 18. In the configuration illustrated in FIG. 11, fuel conduit 18 is configured for fluid communication with fuel circuit 124 on an inlet end 14 and has a frustoconical shape which opens toward an outlet end 15 and outlet 17 of adapter 52 adjoining nozzle tip 50.

Fluid conduit 38 is configured for fluid communication with fluid circuit 124 on inlet end 14 and has a frustoconical ring shape which opens toward outlet end 15 and outlet 19 of adapter 52 adjoining nozzle tip 50 and surrounds fuel conduit 18.

A plurality of four fuel outlet conduits 24 are radially spaced from longitudinal axis 29 by any suitable radial spacing and circumferentially spaced from one another by any suitable circumferential spacing. In the embodiment of FIG. 11, the conduits are spaced equally at about 90° intervals. The conduits include the two fuel outlet conduits 24 shown in FIG. 11 that are radially spaced equally about longitudinal axis 29 and that are circumferentially spaced 180° apart. However, any number of additional fuel outlet conduits 24 may be used with any suitable radial or circumferential spacing. Fuel outlet conduits 24 have inlets 27 located within the circular cross-section of fuel conduit 18. Fuel outlet conduits 24 may have a smaller cross-sectional area and a different cross-sectional shape than fuel conduit 18 in order to increase the pressure of the pressurized liquid fuel 26 and provide jets 23 of liquid fuel 26 having predetermined jet characteristics, such as pressure, flow rate, jet shape and the like. Fuel outlet conduits 24 and fuel outlets 22 may have any suitable cross-sectional shape, cross-sectional size, length, spatial location and orientation in order to provide jets 23 having predetermined jet characteristics using the portion of pressurized liquid fuel 26 that flows therein. The predetermined jet characteristics may be selected to provide atomization of the liquid fuel as described herein. In the exemplary embodiment of FIG. 11, fuel outlet conduits 24 have respective inwardly converging fuel outlet conduit axes 28 and fuel outlets 22 and fuel outlet conduits 24 are spaced to provide jets 23 of liquid fuel 26 that converge inwardly away from outlet end 16. In the exemplary embodiment of FIG. 12, fuel outlets 22 are radially and circumferentially spaced about a longitudinal axis 29 so that respective jets of liquid fuel 23 are focused along longitudinal axis 29 at a focal point 31 that is determined by the fuel jet angle ($\alpha$) that is defined by the angle of the fuel outlet conduit axes 28 with longitudinal axis 29. The fuel jet angle ($\alpha$) may be selected to provide predetermined impact characteristics of jets 23 to provide a resultant flow stream 25 of atomized liquid fuel 26 having predetermined stream characteristics, including the stream shape, size, atomized particle size (e.g., average size) and size distribution, liquid fuel mass flow rate and the like. In this embodiment, fuel injector 100 may advantageously be operated with just a flow of pressurized liquid fuel 26, and without the use of a pressurized liquid fluid 46, such as water, flowing in the fluid circuit 126, and still provide a stream of atomized liquid fuel 26 for combustion.

A plurality of four fluid outlet conduits 44 are radially spaced from longitudinal axis 29 by any suitable radial spacing and circumferentially spaced from one another by any suitable circumferential spacing. In the embodiment of FIG. 11, the conduits are spaced equally at 90° intervals. The conduits include the two fluid outlet conduits 44 shown in FIG. 11 that are radially spaced equally about longitudinal axis 29 and that are circumferentially spaced 180° apart. However, any number of additional fluid outlet conduits 44 may be used with any suitable radial or circumferential spacing. In the illustrated embodiment, the radial spacing of fluid outlet conduits 44 is greater than the radial spacing of fuel outlet conduits 24 such that the fuel outlet conduits 24 and fuel outlets 22 are concentrically disposed within the fluid outlet conduits 44 and fluid conduits 42. Fluid outlet conduits 44 have inlets 47 located within the annular or ring-shape cross-section of fluid conduit 38. Fluid outlet conduits 44 may have a smaller cross-sectional area and a different cross-sectional shape than fluid conduit 38 in order to increase the pressure of the pressurized liquid fluid 46 and provide jets 43 of liquid fluid 46 having predetermined jet characteristics, such as pressure, flow rate, jet shape and the like. Fluid outlet conduits 44 and fluid outlets 42 may have any suitable cross-sectional shape, cross-sectional size, length, spatial location and orientation in order to provide jets 43 having predetermined jet characteristics from the portion of pressurized liquid fluid 46 that flows therein. The predetermined jet characteristics may be selected to provide further atomization of the liquid fuel 26, as described herein. In the exemplary embodiment of FIG. 11, fluid outlet conduits 44 have respective inwardly converging fluid outlet conduit axes 48 and fluid outlets 42 and conduits 44 are spaced to provide jets 43 of liquid fluid 46 that converge inwardly away from outlet end 16. In the exemplary embodiment of FIG. 11, fluid outlets 42 are radially and circumferentially spaced about longitudinal axis 29 of nozzle body 12 so that a jet 43, or plurality of jets 43, of liquid fluid 46 is focused to also impact the plurality of jets, of liquid fuel 26 along longitudinal axis 29 at a focal point that is determined by the fuel jet angle ($\alpha$) and fluid jet angle ($\beta$), where angle $\beta$ is defined by the angle of the fluid outlet conduit axes 48 with longitudinal axis 29. This angle ($\beta$) may be selected to provide predetermined impingement and impact characteristics of jet or jets 23 and jet or jets 43, including a resultant flow stream 25 of atomized liquid fuel 26 having predetermined stream characteristics, including the stream shape, size, atomized particle size (e.g., average size) and size distribution, liquid fuel mass flow rate and the like.

In this embodiment, liquid fluid 46 may include water to provide a predetermined combustion characteristic, such as a reduction of the temperature within the combustor, the turbine inlet temperature, or the firing temperature. In this embodiment, a plurality of jets 23 of liquid fuel 26 and a plurality of jets 43 of liquid fluid 46 are impacted with one another to atomize and emulsify liquid fuel 26 and liquid fluid 46 (e.g., water) and form flow stream 25 that includes atomized and emulsified liquid fuel 26-liquid fluid 46. Without being intending to be bound by theory, the impact of the jet 23 of liquid fuel and jet 43 of liquid fluid 46 both atomizes and intermixes the liquid fuel 26 and the liquid fluid 46 producing an atomized emulsion of liquid fuel 26-liquid fluid 46. The atomized emulsion may include atomized droplets of water that are covered or coated with fuel. The heat provided by the combustor causes the water droplets to rapidly vaporize. The heat of vaporization associated with vaporization of the water lowers the temperature within the combustor to be lowered and the rapid vaporization causes the droplets to explode, thereby providing even smaller droplets of fuel and further enhancing its atomization and combustion characteristics. Any number of jets 23 may be impacted with any number of jets 43 to provide flow stream 25 that includes atomized and emulsified liquid fuel 26-liquid fluid 46 having the predetermined stream characteristics described herein. In this embodiment, each jet 23 of liquid fuel 26 will be oriented and directed as described herein to be impacted by at least one jet 43 of liquid fluid 46 that has also been oriented and directed to provide the desired impact. The focal point 31 or impact point may be selected to fall on longitudinal axis 29, or may be selected by appropriate orientation and location of fuel outlets 22 and fuel outlet conduits 24 as well as fluid outlets 42 and fluid outlet conduits 44 to position focal point 31 at a location in front of outlet end 16 that is not on longitudinal axis 29, as illustrated in FIG. 7. It will be appreciated that by defining a plurality of jet 23 and jet 43 pairs that are oriented for impact as described herein, a corresponding plurality of focal points 31 may be defined at a corresponding plurality of locations in front of outlet end 16, and that the corresponding plurality of flow streams 25 of atomized liquid fuel 26 may form a composite flow stream 25' having predetermined composite stream characteristics.

Fuel injector nozzle 10 and nozzle body 12 may be formed as an integral component or may be formed as a two-piece component by joining an adapter 52 and nozzle tip 50 as described herein.

The inlet end 14 of fuel injector nozzle 10 is disposed on the outlet end 118 of the fuel injector 100. Nozzle 10 may be disposed on fuel injector 100 by any suitable attachment or attachment method, but will preferably be attached with a metallurgical bond 119. Any suitable metallurgical bond 119 may be used, including a braze joint or a weld that may be formed by various forms of welding. In the exemplary embodiment of FIG. 11, the metallurgical bond 119 includes a butt weld 121. Butt weld 121 may be formed, for example, by first butt welding the inner tube 120 to the inner portion 123 of the inlet end 14 of adapter 52. After any necessary inspection of the inner portion of butt weld 121, the outer tube 122 may be butt welded to the outer portion 125 of the inlet end 14 of adapter 52. As shown in FIG. 11, the inlet end 14 of the nozzle body 12 includes a step 13 and outlet end 118 of the fuel injector 100 includes a step 113 and these steps 13, 113 are matingly disposed. These mating steps may be used to facilitate joining by allowing the welds to be made in different planes and using separate welding operations. In an exemplary embodiment, inlet end may be stepped outwardly, with the inner portion 123 of inlet end 14 protruding outwardly away from the adapter 52, while the outlet end of fuel injector 100 is stepped with inner tube 120 recessed within outwardly projecting outer tube 122.

Figure 12:
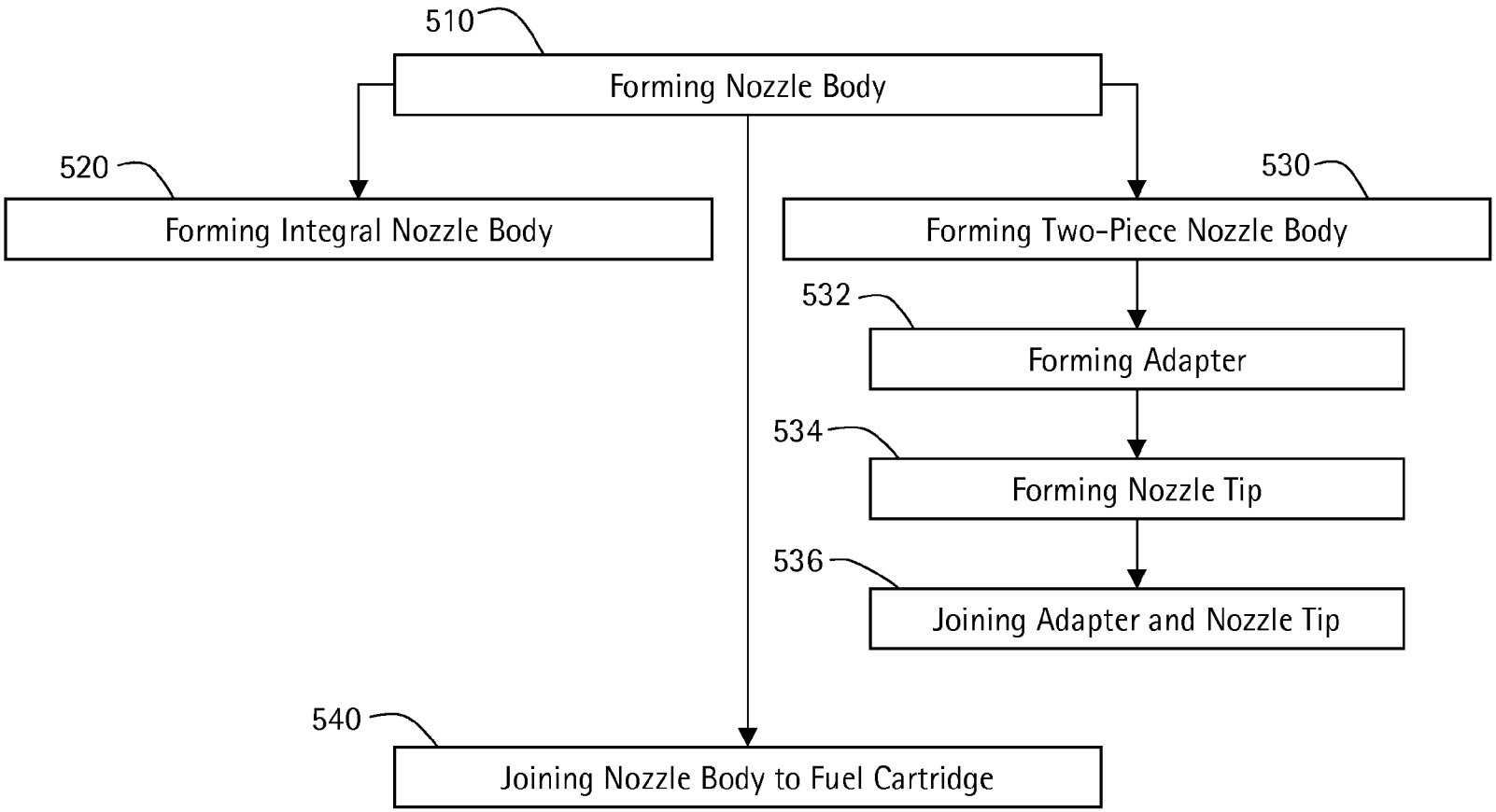
FIG. 12 is a flow chart of a method of making a fuel injector nozzle.

Referring to FIG. 12, a method 500 of making a fuel injector nozzle 10 includes forming 510 a nozzle body 12 for fluid communication of a liquid fuel 26 to produce a liquid fuel jet 23 and a liquid fluid 46 to produce a fluid jet 43 as described herein. As described herein, forming 510 may optionally include forming an integral nozzle 520 body 12, such as by investment casting or sintering a powder metal compact, and may also employ machining, drilling and other metal forming methods to produce various features of nozzle body 12. Alternately, forming 510 may also include forming a two-piece nozzle body 530 by forming 532 the adapter 52, forming 534 the nozzle tip 50 and joining 536 the adapter 52 to the nozzle tip 50, such as by welding or brazing as described herein. Method 500 may also include joining 540 an inlet end 14 of the nozzle body 12 to an outlet end 118 of a fuel injector 100, wherein the inlet end of the nozzle body 12 is stepped with a step 13 and configured for mating engagement with a step 113 on outlet end 118 of the fuel injector 100.

Figure 13:
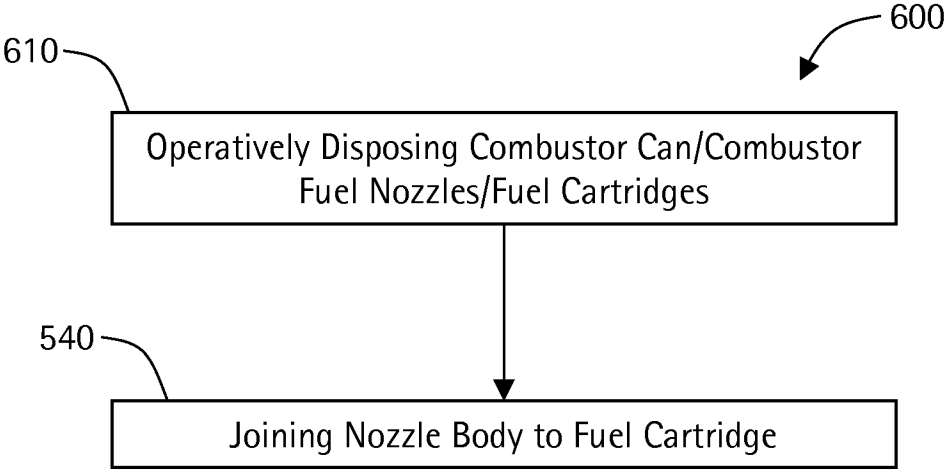
FIG. 13 is a flow chart of a method of controlling a combustor of a gas turbine.

Referring to FIG. 13, a method 600 of controlling a combustor of a gas turbine is disclosed. The combustor and gas turbine may be of any suitable design, including various conventional combustor and gas turbine designs. Method 600 includes operatively disposing 610 a combustor can 300 as described herein in the combustor of the gas turbine. The combustor can 300 includes a plurality of combustor fuel nozzles 200, each having a fuel injector 100 that is configured to selectively provide a liquid fuel, a liquid fluid or liquid fuel and liquid fluid to a fuel injector nozzle 10 that is configured to provide, respectively, a plurality of liquid fuel jets, a plurality of liquid fluid jets or a combination thereof, that are in turn configured to provide an atomized liquid fuel stream, an atomized liquid fluid stream, or an atomized and emulsified liquid fuel-liquid fluid stream, respectively. Method 600 also includes selectively providing 620 an amount of liquid fuel, liquid fluid or a combination thereof to the fuel injector nozzle to produce a predetermined atomized liquid fuel stream, atomized liquid fluid stream, or an atomized and emulsified liquid fuel-liquid fluid stream, respectively.

Method 600 may be used, for example, with the fuel injector 100 illustrated in FIG. 11, to selectively provide 620 pressurized fuel only through fuel conduit 18 and fuel outlet conduits 24 to produce an atomized liquid fuel stream 25 for combustion in the combustor. This operating configuration may be used during a predetermined low load condition of the gas turbine where it is not necessary to limit the combustion temperature or where, for example, the combustor is being ramped up to a predetermined combustion temperature. In an exemplary embodiment, a low load condition is a load that is less than or equal to about 30% of the base load of a gas turbine, and more particularly, a load condition that is about 10% to about 30% of the base load. A high load condition is a load that is greater than about 30% of the base load of the gas turbine. This configuration may be used advantageously, for example, during startup of the gas turbine to define a startup mode. At startup, a low load condition exists such that the use of a cooling fluid, such as water, to cool the combustor in order to control exhaust emissions is generally not necessary. Hence, the supply of fuel only may be used at startup, but the pressurized fuel 26 is atomized as described herein to improve the combustion efficiency.

Method 600 may also be used, for example, with the fuel injector 100 illustrated in FIG. 11, to selectively provide 620 pressurized liquid fuel through fuel conduit 18 and fuel outlet conduits 24 and pressurized fluid, including a cooling fluid such as water, through fluid conduit 38 and fluid outlet conduits 44 to produce an atomized and emulsified liquid fuel 26-liquid fluid 46 stream 25 for combustion in the combustor. This operating configuration may be used during a predetermined operating condition of the combustor where at least one combustor fuel nozzle 200 is configured to provide both liquid fuel and liquid fluid and the corresponding liquid fuel jets and liquid fluid jets provide an atomized and emulsified liquid fuel-liquid fluid stream for combustion in the combustor. This stream may be used, for example, to provide enhanced combustion, including a predetermined combustion efficiency, by the atomization and emulsification of the fuel, as described herein. The liquid fluid, such as water, also reduces the combustion temperature which may be used to control the exhaust emissions from the combustor, particularly by reducing the amount of $NO_X$ produced during combustion, and provide a predetermined profile of emission constituents and a predetermined combustion temperature. Thus, the relative amounts of liquid fuel 26 and liquid fluid 46 supplied by fuel injector may be controlled to provide a predetermined combustion efficiency, combustion temperature or emission constituent profile, or a combination thereof. The amounts may be controlled, whether measured by weight percent or volume percent, from 100>X>0, where X is the amount of fuel in volume or weight percent of the total of liquid fuel and liquid fluid, and the amount of liquid fluid is defined by 1-X. The atomized and emulsified liquid fuel 26-liquid fluid 46 stream 25 may be used advantageously by controlling their amounts over a wide range of normal operating conditions of the combustor and gas turbine to define an operating mode. It may be used with particular advantage at higher turbine speeds and loads, which generally have higher combustion temperatures, and where exhaust emissions compliance requires lowering the combustion temperatures to provide a predetermined profile of emissions constituents.

Method 600 may also be used, for example, with the fuel injector 100 illustrated in FIG. 11, to selectively provide 620 pressurized liquid pressurized liquid fluid only through fluid conduit 38 and fluid outlet conduits 44 to produce an atomized liquid fluid stream 25. This stream may be used, in conjunction with other fuel injectors that are supplying an atomized fuel 26 stream 25 or an atomized and emulsified liquid fuel 26-liquid fluid 46 stream 25 for combustion, to cool the combustor or lower the combustion temperature and provide a cooling mode. It may be used with particular advantage at higher turbine speeds and loads, which generally have higher fuel consumption and combustion temperatures, and where exhaust emissions compliance requires further lowering the combustion temperatures to provide a predetermined profile of emissions constituents. During a high load condition of the combustor, at least one combustor fuel nozzle 200 is configured to provide liquid fluid only and the corresponding liquid fluid jets provide an atomized liquid fluid stream for cooling the combustor or lowering the combustion temperature.

Selectively providing 620 may also include, during a transition from a low load condition of the combustor to an operating condition, configuring at least one combustor fuel nozzle 200 to provide liquid fuel 26 only and the corresponding liquid fuel jets 23 provide an atomized liquid fuel stream 25 for combustion in the combustor during the low load condition, and the transition comprises also providing liquid fluid to these combustor fuel nozzles such that the liquid fuel jets and liquid fluid jets provide atomized and emulsified liquid fuel-liquid fluid streams for combustion in the combustor. Alternately, the transition may comprise configuring a plurality of other combustor fuel nozzles 200 to simultaneously provide both liquid fuel 26 and liquid fluid 43 and the corresponding liquid fuel jets 26 and liquid fluid jets 23 of the other combustor fuel nozzles 200 provide an atomized and emulsified liquid fuel-liquid fluid stream 25 for combustion in the combustor. The amount of the liquid fluid provided during the transition may be varied as a function of time. For example, the amount of liquid fluid may be increased according to a predetermined profile as a function of time. This may be used, for example, to control the rate of heating of the combustor, or the rate of increase of the combustion temperature, in order to obtain a predetermined value of the combustor temperature, or combustion temperature, or a combination thereof, or to obtain a predetermined profile of emission constituents.

Selectively providing 620 may also include, during a transition from an operating condition to a cooling condition, configuring at least one combustor fuel nozzle 200 to provide liquid fuel 26 and liquid fluid 46 to the combustor fuel nozzle 200 such that the liquid fuel jets 23 and liquid fluid jets 43 provide atomized and emulsified liquid fuel-liquid fluid streams 25 for combustion in the combustor during the operating condition, and the transition comprises defueling the combustor fuel nozzle such that the liquid fluid jets provide atomized liquid fluid streams for cooling in the combustor. The amount of the liquid fuel 26 provided during the transition may be varied as a function of time. For example, the amount of liquid fluid may be increased according to a predetermined profile as a function of time. This may be used, for example, to control the rate of cooling of the combustor, or the rate of decrease of the combustion temperature, in order to obtain a predetermined value of the combustor temperature, or combustion temperature, or a combination thereof, or to obtain a predetermined profile of emission constituents.

In addition to the control described herein that may be affected within a single fuel injector 100 housed within a single combustor fuel nozzle 200, control may also be affected within the plurality of combustor fuel nozzles 200 of a single combustor can 300, or among the plurality of combustor fuel nozzles 200 of a plurality of combustor cans 300 within a combustor of a gas turbine. For example, in an exemplary embodiment, any or all of the combustor cans 300 of a combustor may be configured so that the startup mode, operating mode or cooling mode, or a combination thereof, as described herein may be provided therein.

The use of fuel injector nozzle 10 and fuel injector 100 enable elimination of atomizing air systems while also improving fuel atomization and achieving emissions reductions by lowering the operating temperature during liquid fuel operation of gas turbine combustors that incorporate them, as described herein, thereby substantially reducing their complexity and system, maintenance and operation costs. Currently, water is already injected to lower operating temperatures and reduce emissions during liquid fuel operation, but the use of fuel injector 100 and fuel injector nozzle 10 and methods of their use disclosed herein make dual use of the liquid fluid (e.g., water) injection to also provide atomization of the liquid fuel, and have a further significant advantage because they can readily by retrofitted into the combustors of existing gas turbines.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fuel injector nozzle, comprising:

a nozzle body in fluid communication with a liquid fuel source to produce a plurality of liquid fuel jets and a fluid source to produce a plurality of liquid fluid jets, the nozzle body comprising:

an adapter comprising a fuel conduit and a fluid conduit; and a nozzle tip disposed on the adapter comprising a plurality of fuel outlet conduits that are in fluid communication with the fuel conduit and a plurality of fluid outlet conduits that are in fluid communication with the fluid conduit, wherein the plurality of liquid fluid jets and the plurality of liquid fuel jets are configured to impact one another at a focal point spaced from an outlet end of the nozzle tip and produce an atomized stream of liquid fuel.

2. The fuel injector nozzle of claim 1, wherein the nozzle body is an integrally formed body.

3. The fuel injector nozzle of claim 2, wherein the nozzle body comprises an investment casting or a sintered powder metal compact.

4. The fuel injector nozzle of claim 1, wherein the nozzle body is a two-part body comprising the adapter and the nozzle tip that are joined by a metallurgical bond.

5. The fuel injector nozzle of claim 4, wherein the metallurgical bond comprises a weld or a braze joint.

6. The fuel injector nozzle of claim 1, further comprising a fuel injector that comprises:

a partitioned tube having an inlet end, an outlet end, a fluid circuit and a fuel circuit, an inlet end of the nozzle body disposed on the outlet end of the fuel injector with the fuel circuit in fluid communication with the fuel conduit and the fluid circuit in fluid communication with the fluid conduit.

7. The fuel injector nozzle of claim 6, wherein the inlet end of the nozzle body is disposed on the outlet end of the fuel injector with a metallurgical bond.

8. The fuel injector nozzle of claim 7, wherein the metallurgical bond comprises a butt weld between the inlet end of the nozzle body and outlet end of the fuel injector.

9. The fuel injector nozzle of claim 6, wherein the inlet end of the nozzle body and outlet end of the fuel injector each include a step and the steps are matingly disposed.

10. The fuel injector nozzle of claim 6, wherein the fuel circuit and fluid circuit are concentrically disposed within the partitioned tube, the partitioned tube comprises an inner tube concentrically disposed within an outer tube and the inner tube is stepped in relation to the outer tube on the outlet end.

11. The fuel injector nozzle of claim 10, wherein fuel conduit and fluid conduit are concentrically disposed within the adapter and the adapter comprises an inner adapter portion concentrically disposed within an outer adapter portion and the inner adapter portion is stepped in relation to the outer adapter portion on the inlet end of the nozzle body.

12. The fuel injector nozzle of claim 11, wherein the inner adapter portion is stepped outwardly away from the nozzle body in relation to the outer adapter portion and the inner tube is stepped inwardly toward the partitioned tube in relation to the outer tube, wherein the nozzle body is disposed on the portioned tube by a first metallurgical bond between the inner tube and the inner adapter portion and a second metallurgical bond between the outer tube and the outer adapter portion.

13. The fuel injector nozzle of claim 12, wherein the first metallurgical bond and the second metallurgical bond each comprise a butt weld.

14. The fuel injector nozzle of claim 12, wherein the plurality of fuel outlet conduits and the plurality of fluid outlet conduits are radially and circumferentially spaced about a longitudinal axis of the nozzle body and concentrically disposed in relation to one another within the nozzle tip, and wherein the plurality of fuel outlet conduits convergingly extend from the fuel conduit to a plurality of fuel outlets and the plurality of fluid outlet conduits convergingly extend from the fluid conduit to a plurality of fluid outlets.

15. The fuel injector nozzle of claim 14, wherein the fuel outlet conduits are configured so that the plurality of fuel jets converge and the fluid outlet conduits are configured so that the plurality of fluid jets converge.

16. The fuel injector nozzle of claim 15, wherein the plurality of fuel jets converge at a fuel focal point and the plurality of fluid jets converge at a fluid focal point.

17. The fuel injector nozzle of claim 6, further comprising a combustor fuel nozzle comprising a natural gas circuit that extends between a proximal and distal end and defines a fuel injector cavity, wherein the fuel injector is disposed in the fuel injector cavity with an outlet end of the nozzle body disposed in an opening at the distal end of the combustor fuel nozzle, wherein the nozzle body is configured to inject liquid fuel and liquid fluid to form an atomized fuel-liquid fluid emulsion for discharge into a combustion chamber through the opening.

18. The fuel injector nozzle of claim 17, further comprising a combustor can comprising a plurality of combustor fuel nozzles and fuel injectors.

19. The fuel injector nozzle of claim 18, further comprising a combustor for a turbine comprising a plurality of combustor cans, each combustor can comprising a plurality of combustor fuel nozzles and fuel injectors.

20. The fuel injector nozzle of claim 1, wherein the nozzle body comprises a superalloy.

* * * * *